US005794108A

United States Patent [19]

Yoshizawa et al.

[11] Patent Number: 5,794,108

[45] Date of Patent: Aug. 11, 1998

[54] DEVELOPMENT DEVICE OF AN IMAGE FORMING APPARATUS AND A DRIVEN TONER BOTTLE FOR USE IN THE DEVELOPMENT DEVICE

[75] Inventors: Hideo Yoshizawa, Urawa; Shigeru Yoshiki, Tokyo, both of Japan

[73] Assignee: Ricoh Company, Ltd., Tokyo, Japan

[21] Appl. No.: 781,044

[22] Filed: Jan. 9, 1997

[30] Foreign Application Priority Data

Jan. 9, 1996 [JP] Japan ..... 8-001498
May 8, 1996 [JP] Japan ..... 8-113539

[51] Int. Cl.[6] ..... G03G 15/08

[52] U.S. Cl. ..... 399/262; 222/DIG. 1; 399/258

[58] Field of Search ..... 399/258, 261, 399/262; 222/DIG. 1

[56] References Cited

U.S. PATENT DOCUMENTS

| | | | |
|---|---|---|---|
| 4,611,730 | 9/1986 | Ikesue et al. | 222/DIG. 1 |
| 4,949,123 | 8/1990 | Takashima | 399/262 X |
| 5,047,803 | 9/1991 | Kanoto | 399/111 |
| 5,416,568 | 5/1995 | Yoshiki et al. | 399/285 |
| 5,455,662 | 10/1995 | Ichikawa et al. | 399/260 |
| 5,500,719 | 3/1996 | Ichikawa et al. | 399/238 |
| 5,557,381 | 9/1996 | Sakamoto et al. | 399/111 |
| 5,557,382 | 9/1996 | Tatsumi et al. | 399/262 |

FOREIGN PATENT DOCUMENTS

| | | |
|---|---|---|
| 3-103462 | 10/1991 | Japan . |
| 6-348127 | 12/1994 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

An opening portion formed in the head of a toner bottle containing a toner is attached to a body of a development device of an image forming apparatus. The toner bottle is then turned so as to supply the development device with the toner. A projection for turning the toner bottle is formed on a circumferential surface on the bottom side of the toner bottle. On the development device side, a driving source is mounted which drives and turns the toner bottle through the projection when the toner bottle is attached to the development device body.

17 Claims, 10 Drawing Sheets

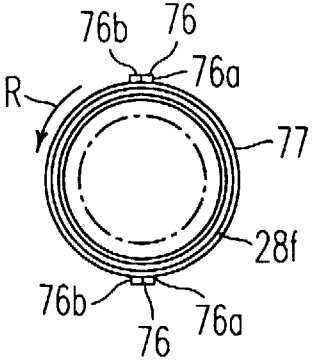
FIG. 8B
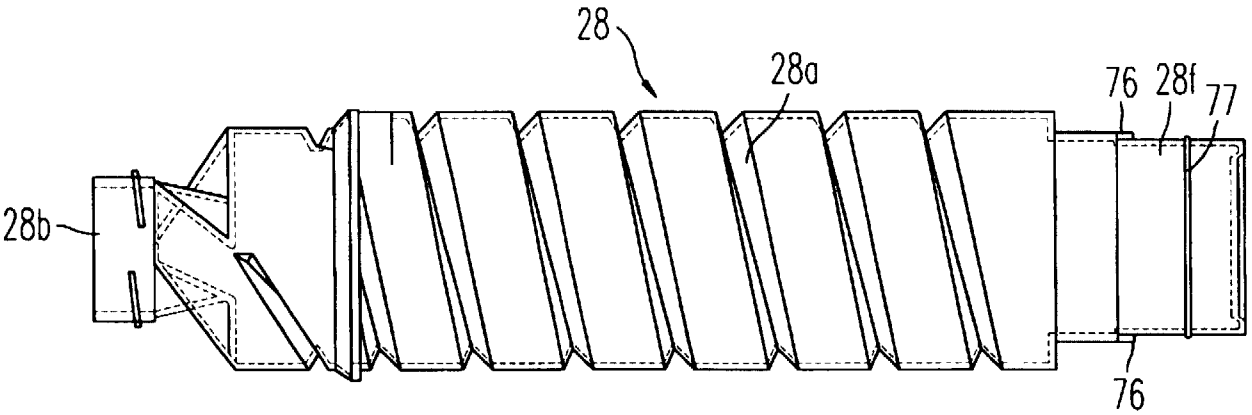
FIG. 8A
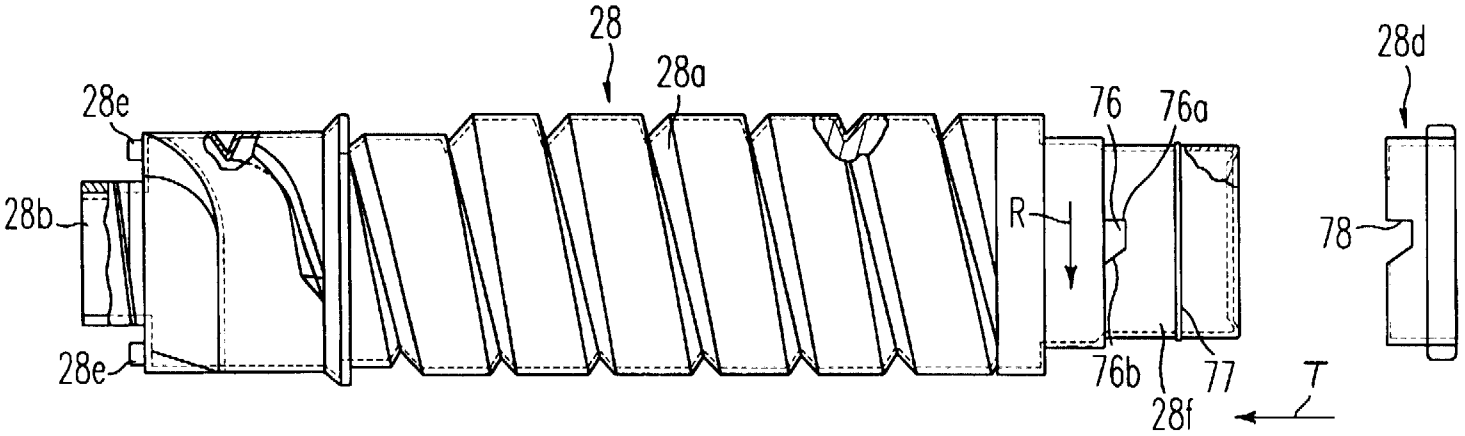
FIG. 8D
FIG. 8C

DEVELOPMENT DEVICE OF AN IMAGE FORMING APPARATUS AND A DRIVEN TONER BOTTLE FOR USE IN THE DEVELOPMENT DEVICE

BACKGROUND OF THE INVENTION

1. Field of the Invention

This invention relates to a development device in an image forming apparatus and a toner bottle for use in the development device. More particularly, this invention relates to a screw type toner bottle and a development device in which toner is supplied from the toner bottle attached to a hopper.

2. Description of Related Art

Conventionally, an electrophotographic type of image forming apparatus is provided with a development device which visualizes an electrostatic latent image formed on an image carrying medium. The development device has a toner supply unit which supplies toner.

A toner supply unit of a development device in most general use has a construction as shown in FIG. 14. In FIG. 14, reference numeral 80 designates a photoconductor drum, reference numeral 82 designates a development device, reference numeral 84 designates a development roller, and reference numeral 86 designates a paddle roller. The development device 82 has a toner cartridge 88 which contains toner and a toner hopper 90 which supplies toner. The toner in the toner cartridge 88 is stirred with an agitator 92, and the toner hopper 90 is replenished with the toner. The reason why the toner is temporarily stored in the toner hopper 90 is that a supply of the toner to a development portion 82*a* by means of a toner supply roller 94 is made as constant as possible. Accordingly, a toner density of the toner in the development portion 82*a* is kept constant.

Recently, a small-sized development device with smaller structural space requirements has been developed. This development device has a construction in which a screw type of toner bottle is horizontally attached to the toner hopper 90 so as to supply the toner.

Generally, an image forming apparatus using the screw type of toner bottle includes a driving source exclusively used to turn the toner bottle. As an example, in order to turn the toner bottle by means of the driving source, use is made of a structure in which the driving source provides rotation for a front flange serving as a joint member with which the hopper 90 is connected to an opening of the toner bottle, and the rotation is transmitted to the toner bottle.

As another example, use is made of a structure in which a driven gear is mounted on a circumferential surface of an opening portion of the head of a toner bottle whose bottle diameter is the same as the opening diameter of the opening portion, the driven gear is then engaged with a driving gear mounted on the apparatus side, and the rotation of the driving gear is transmitted to the toner bottle.

In the screw type of toner bottle, cases occur in which part of the toner stagnates in the bottle and, as a result, the stagnating toner stops the remaining toner from being discharged from the opening of the bottle because the toner is conveyed only toward the head side from the bottom side of the bottle. Accordingly, the stagnation brings about fluctuation of the replenishment quantity of the toner in the bottle.

As a solution to this problem, this type of development device is provided with a mechanism for tapping and vibrating the toner bottle, in order to prevent the toner from adhering to the inner wall of the bottle and stagnating there.

This vibration results in the fluctuation of the toner replenishment quantity and makes it impossible to continue supplying a fixed quantity of toner.

However, it is undesirable to independently use the mechanism adapted to tap and vibrate the toner bottle because a compact, simple image forming apparatus is in demand nowadays. In addition, preferably, consumables used in the apparatus are recyclable from the modern viewpoint of resource saving.

In order to achieve the recycling, preferably, the toner bottle and the driven gear are disjoinable. In a method of separating the driven gear from the toner bottle, an operator often suffers pain because of contact of the operator's hand with the teeth of the driven gear when the driven gear is pulled to be removed from the toner bottle. For this reason, a disjoining operation is expected to be carried out with great ease, but a construction is required in which the driven gear does not easily slip off from the toner bottle while the toner bottle is rotating.

SUMMARY OF THE INVENTION

The present invention was made in view of the foregoing.

It is a first object of the present invention to provide a development device of an image forming apparatus and a toner bottle used in the development device which is capable of restraining a toner from stagnating in the toner bottle as much as possible.

It is a second object of the present invention to provide a development device of an image forming apparatus and a toner bottle used in the development device which is recyclable.

It is a third object of the present invention to provide a development device of an image forming apparatus and a toner bottle used in the development device in which a driven gear cannot easily slip from the toner bottle during the rotation of the toner bottle and, in addition, the driven gear can be easily removed from the toner bottle in the case where a construction is adopted in which the driven gear is disjoinable and removable from the toner bottle.

The present inventor has found that the toner is conveyed more smoothly and is supplied stably by applying vibrations generated by the rotation of the toner bottle to the bottom side of the toner bottle. In other words, the inventor has found that it is preferable to place a source of vibrations generated by the rotation of the toner bottle at the bottom side of the toner bottle which is an upstream side in a conveyed direction of the toner, in order to efficiently exert an influence of the vibrations upon the toner bottle all over. Additionally, the inventor has found that greater vibrations generated by the rotation can be applied to the toner bottle in proportion to the degree of engagement roughness between the driving gear and the driven gear comprising a plurality of projections.

In order to achieve the objects, a development device of an image forming apparatus according to the present invention is constructed as follows. In a development device in which an opening portion formed in a head of a toner bottle containing a toner is attached to a body of the development device and the toner bottle is then turned so as to supply the development device with the toner, a projection for turning the toner bottle is formed on a circumferential surface of a bottom portion of the toner bottle, and, on the development device side, a driving source is mounted for turning the toner bottle through the projection when the toner bottle is attached to the body of the development device.

Since the projection for providing the rotation is formed on the bottom side of the toner bottle, vibrations generated by the rotation can be provided to the bottom side thereof, and accordingly the toner is efficiently prevented from adhering to the inner wall of the toner bottle because of the vibrations on the bottom side thereof.

A driven gear which is formed independently of the toner bottle and is rotatable in conjunction with rotation of the driving source may be attached to the bottom portion of the toner bottle and be engaged with the projection of the toner bottle. This arrangement results in a simple construction because the driven gear for turning the toner bottle can serve to provide vibrations to the toner bottle additionally.

If the driven gear is freely attachable to the toner bottle and detachable therefrom, the toner bottle and the driven gear can be recycled.

A driving gear which is turned by the driving source and is engaged with the driven gear may be mounted on the side of the development device so that the driving source can be used in common.

If a module of the driven gear and a module of the driving gear are arranged to be each more than 1.25, greater vibrations generated by the rotation of the toner bottle can be obtained by the use of engagement roughness between the gears.

If a construction is adopted in which an exclusive driving source is mounted for turning the toner bottle independently of the driving source mounted on the development device side and the toner bottle is reversed with a given timing, the vibrations of the toner bottle can be enhanced even more and therefore the toner can be more effectively prevented from stagnating in the toner bottle.

If the driving source for turning the toner bottle is used in common with the a driving source for turning a development sleeve, the development device can be made small-sized and simpler.

If the projection has an engagement surface parallel to a removal direction of the driven gear and an inclined surface inclining with respect to the removal direction, a greater pulling force can be obtained by applying a rotational force to the driven gear. Accordingly, the driven gear can be easily removed without feeling any pain in the hand and a disjoining operation can be carried out with great ease, and recycling can be improved even if the driven gear is designed not to easily slip off from the toner bottle during the rotation of the toner bottle.

If a construction is adopted in which the projection has an engagement surface extending radially and a tapered surface gradually becoming smaller in height in a rotational direction, the driven gear can be removed by providing deformation to the bottom side of the toner bottle by the use of a rotational force of the driven gear. Accordingly, a disjoining operation can be carried out with great ease as above.

If the projection is one in number, a chance to go beyond a slip-off preventive ridge can be easily obtained. Accordingly, the driven gear can be more easily removed.

BRIEF DESCRIPTION OF THE DRAWINGS

FIG. 6 is an enlarged longitudinal sectional view of the hopper portion a part of which is omitted.

FIG. 8(*a*) is a side view of a toner bottle in a third embodiment of the present invention, FIG. 8(*b*) is a bottom view of the toner bottle a part of which is omitted, FIG. 8(*c*) is a side view of the toner bottle as a result of rotation of the toner bottle shown in FIG. 8(*a*) by an angle of 90°, and FIG. 8(*d*) is a side view of a driven gear which is to be mounted on the bottom side of the toner bottle shown in FIGS. 8(*a*) to 8(*c*).

DETAILED DESCRIPTION OF THE PREFERRED EMBODIMENTS

A description will hereinafter be given of embodiments of a development device of an image forming apparatus according to the present invention with reference to the attached drawings.

First Embodiment

Figure 2:
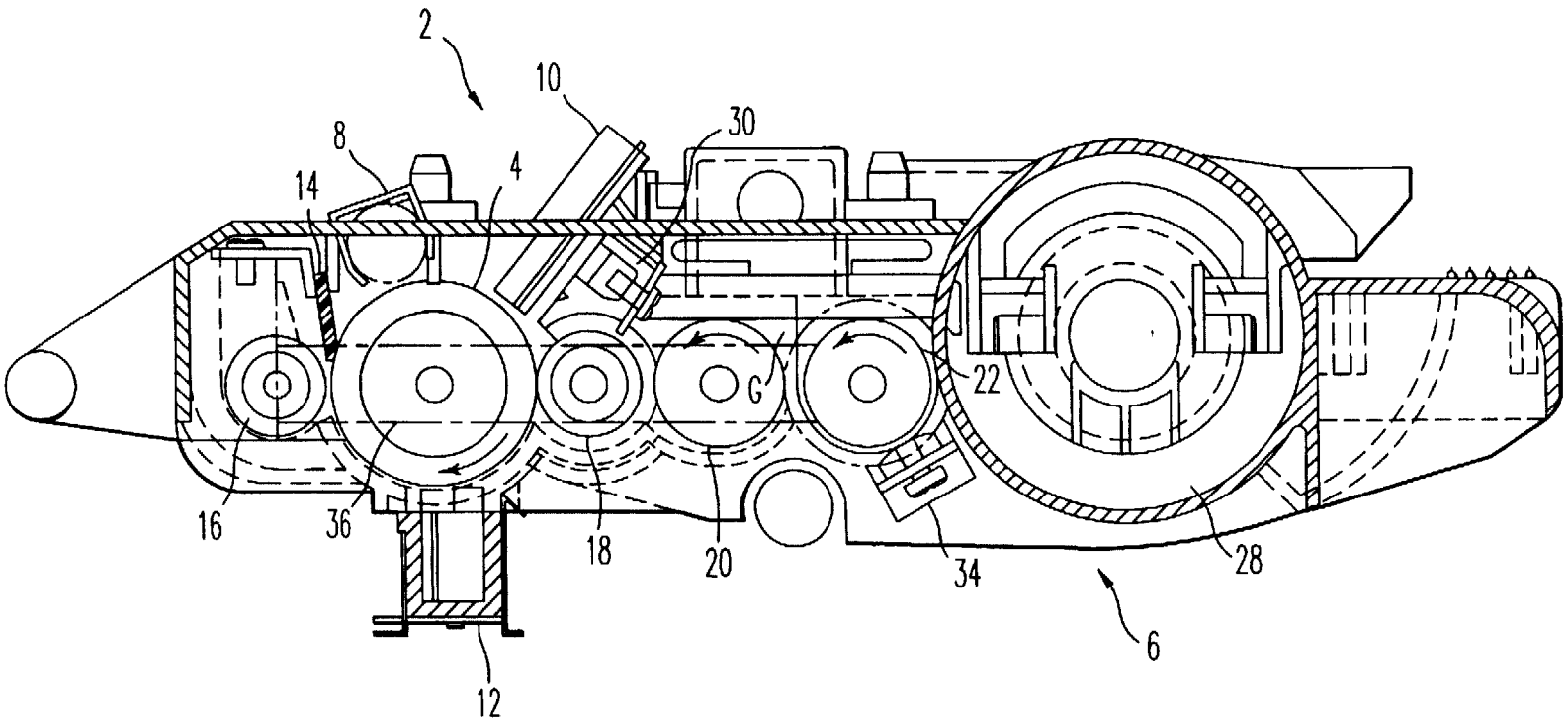
FIG. 2 is a sectional view schematically showing an image forming apparatus of the present invention.
Figure 3:
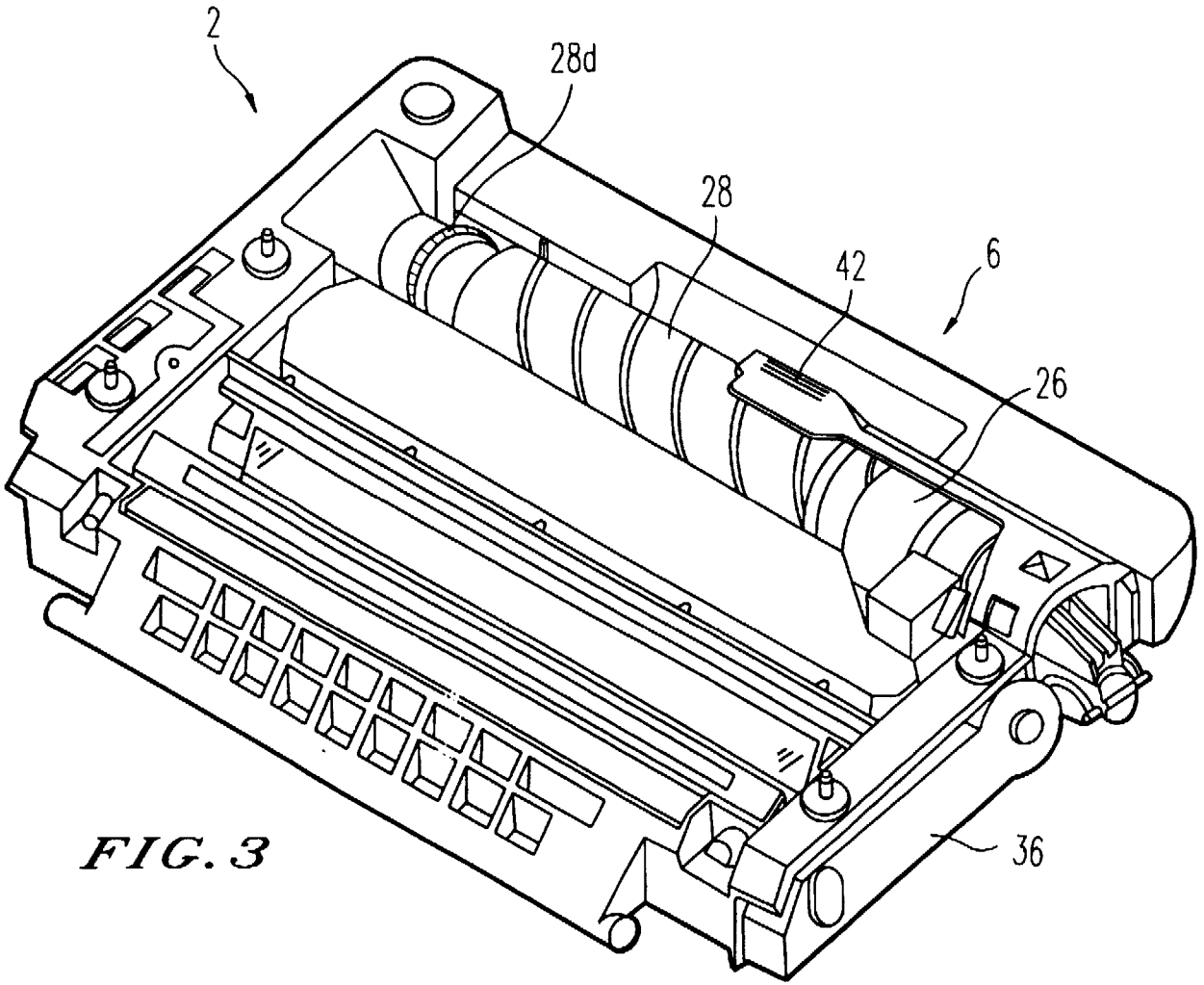
FIG. 3 is a perspective view of the image forming apparatus.
Figure 4:
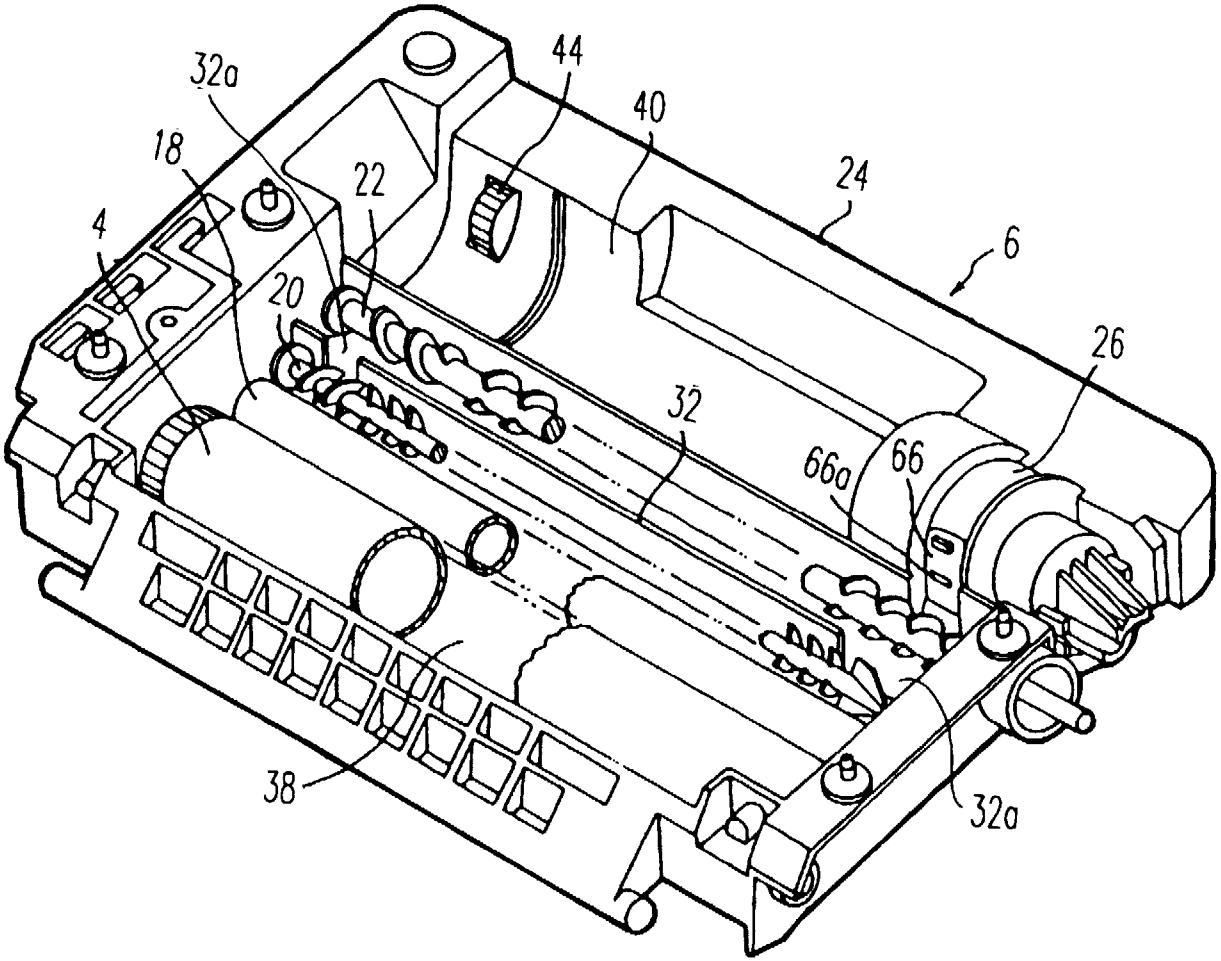
FIG. 4 is a perspective view of the image forming apparatus, showing a state in which constituent parts, such as a cover, have been removed.

As shown in FIGS. 2 to 4, an image forming apparatus 2 includes a photoconductor drum 4 and a development device 6. Around the photoconductor drum 4, there are disposed an electric charger 8, an eraser 10, a transfer unit 12, a cleaning blade 14, and a toner conveying coil 16.

The development device 6 includes a development sleeve 18, two agitation screws 20 and 22, a hopper 26, and a screw type toner bottle 28. The development sleeve 18 is laid horizontally and is used to supply the photoconductor drum 4 with toner. The agitation screws 20, 22 are laid parallel to the development sleeve 18 and is used to agitate, mix, and convey a developing agent (developing powder) contained in a development casing 24 in different directions. The hopper 26 is formed integrally with the casing 24. The toner bottle 28 for containing toner is to be attached to the hopper 26. The attachment of the toner bottle 28 thereto will be described later.

A doctor blade 30 is disposed above the development sleeve 18. The role of the doctor blade 30 will be described later.

Between the agitation screws 20 and 22, a partition member 32 extends along them. Interconnection passages 32*a* and 32*a* are formed in the front and rear ends of the partition member 32, respectively. The developing powder G (indicated by dots in FIG. 2) circulates through the passages 32*a*. A permeability measuring sensor 34 for measuring the permeability of the developing powder G is disposed under a part in the longitudinal direction of the agitation screw 22. Based on detection data obtained by the permeability measuring sensor 34, the toner density in the casing 24 is controlled. In FIG. 2, reference numeral 36 designates a conveying path for toner recycling.

A description will now be given of a process of image formation of the image forming apparatus 2.

First, the electricity of the photoconductor drum 4 is removed during its rotation by means of electricity removal light. Thereby, a surface potential thereof is averaged to a reference potential of 0 V to −150 V. The photoconductor drum 4 is then charged by the charger 8. As a result, the surface potential of the photoconductor drum 4 becomes −900 V or so. Thereafter, the photoconductor drum 4 is exposed by an exposure unit. A part (i.e., an image portion) of the photoconductor drum 4 which is not illuminated with light maintains a surface potential of −500 V to −850 V. Accordingly, toner on the development sleeve 18 adheres to the image portion regardless of the application of a bias voltage of about −200 V to the development sleeve 18.

The photoconductor drum 4 on which a toner image is formed still continues to rotate. Transfer paper is sent from a paper feeder (not shown) with timing with which a coincidence occurs between the front end of the paper and the front end of the image portion in the transfer unit 12. The toner image formed on the surface of the photoconductor drum 4 is transferred to the transfer paper by means of the transfer unit 12. The transfer paper is then sent to a fuser (not shown). The toner is fused to the transfer paper by heat and pressure of the fuser, and the resultant transfer paper is discharged as a copy.

The residual toner remaining on the photoconductor drum 4 is scraped away from the photoconductor drum 4 by means of the cleaning blade 14. The residual electricity of the photoconductor drum 4 is then removed by electricity removal light, and thereby the photoconductor drum 4 becomes immaculate without any toner. Thereafter, the following process of image formation starts again.

The photoconductor drum 4, electricity removal device (quenching device), development device 6, and cleaning device are contained in a photoconductor case 38 a part of which is the development casing 24. The residual toner recovered by the cleaning device is conveyed by the toner conveying coil 16 to a recycled-toner conveying unit. The residual toner is then conveyed to the agitation screw 22 through the toner recycling path 36. The toner is thus recycled.

The development device 6 will be described in detail.

The development sleeve 18 has a fixed shaft in which five-polar magnets are disposed. The outer circumferential surface of the fixed shaft is covered with a non-magnetic pipe material. By the rotation of the pipe material, the developing agent (developer) G moves on the development sleeve 18. The developing agent G is of a two-component type which consists of toner and particles of iron called carrier. The toner is provided with electric charge while being circulated by the agitation screws 20 and 22. The toner adheres to the carrier and is conveyed to the surface of the photoconductor drum 4. By the action of electrostatic force, the toner reaches a state capable of adhering to the photoconductor drum 4. The carrier of the developing agent G merely circulates whereas the toner thereof is consumed by the adhesion to the image portion of the photoconductor drum 4. Thus, toner is suitably replenished.

Nonuniformity or inferiority in density occurs to a formed image unless a fixed quantity of developing agent G is continuously supplied to the photoconductor drum 4. The doctor blade 30 mentioned above serves to control an inflow of the developing agent G.

As shown in FIG. 4, a concave 40 for attachment of the toner bottle 28 is formed integrally with the development casing 24 and is formed to match the outer shape of the toner bottle 28. The toner bottle 28 is laid as horizontally as the development sleeve 18 and the agitation screws 20, 22.

Figure 1:
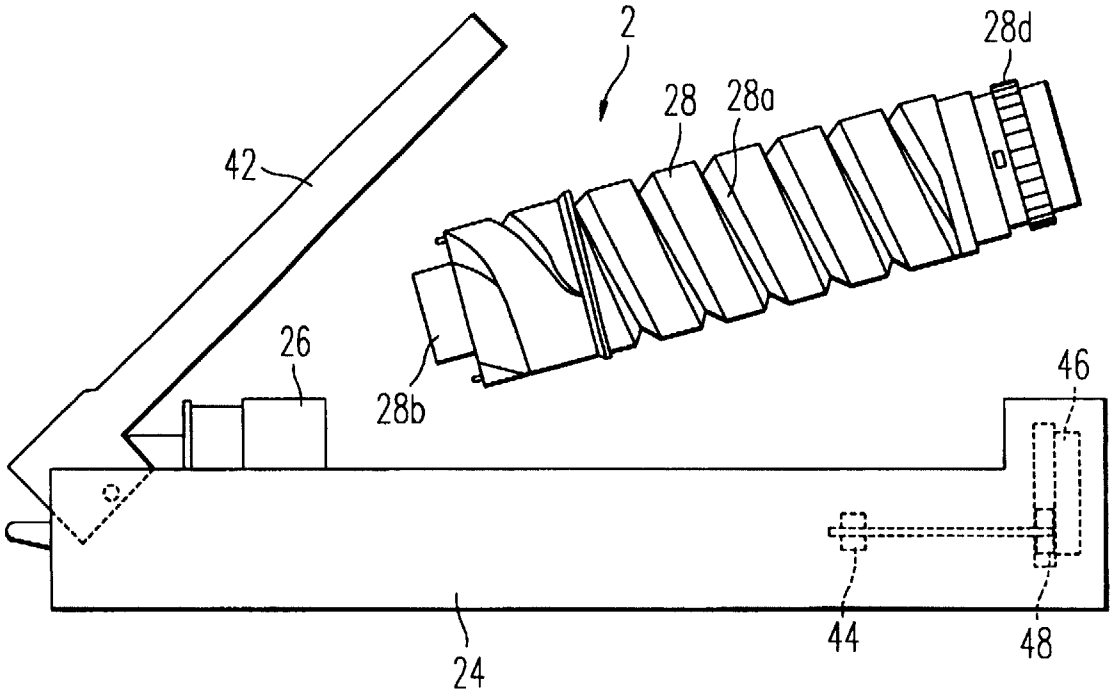
FIG. 1 is a side view schematically showing a development device according to a first embodiment of the present invention, in a state in which a toner bottle is not yet attached to the development device.
Figure 5:
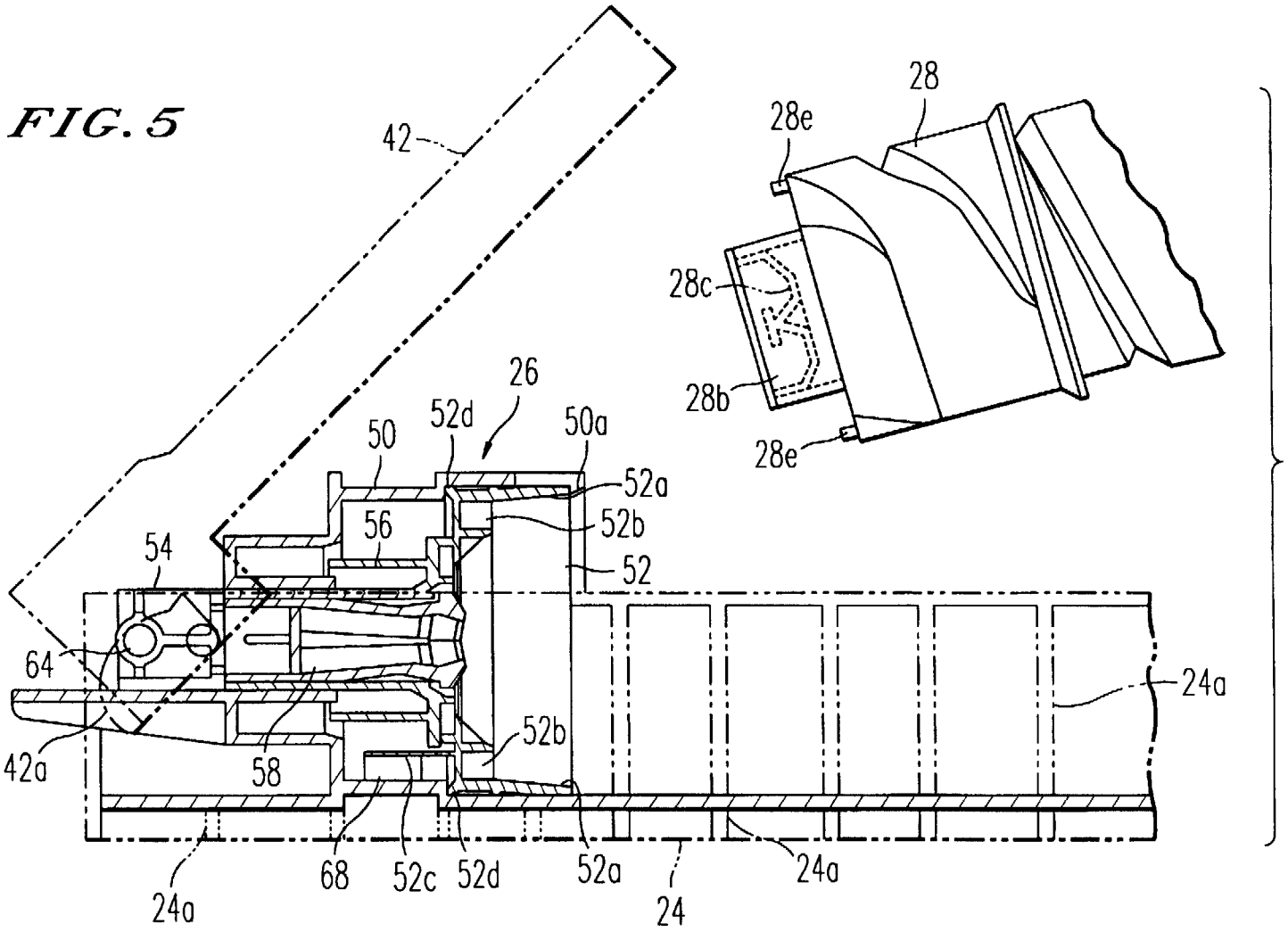

As shown in FIGS. 1, 3, and 5, the hopper 26 is provided with a handle 42 used as an operating means for allowing toner contained in the toner bottle 28 to enter the inside of the development casing 24. With the handle 42 raised up, the toner bottle 28 is attached to the attachment concave 40.

A spiral ridge 28*a* is formed on the inner wall of the toner bottle 28. A toner outlet 28*b* as an opening is formed in the head of the toner bottle 28. A cap 28*c* for preventing the toner from escaping from the toner bottle 28 is fitted in the toner outlet 28*b*. The toner is discharged from the toner outlet 28*b* by turning the toner bottle 28 which has been attached to the hopper 26.

On the bottom side of the toner bottle 28, a driven gear 28*d* for turning the toner bottle 28 is formed integrally. The attachment concave 40 is provided with a driving gear 44 which is engaged with the driven gear 28*d* when the toner bottle 28 is attached to the attachment concave 40. A part of the driving gear 44 protrudes from the surface of the attachment concave 40. The driving gear 44 is connected to a gear train 46 mounted on the apparatus side via a connection gear 48. The gear train 46 drives the agitation screws 20, 22 and the like.

The toner bottle 28 is set to be substantially parallel to the photoconductor drum 4, etc., in other words, is set horizontally. In the first embodiment of the present invention, unification of driving sources is achieved such that a driving source mounted on the apparatus side drives the toner bottle 28, and this realizes a more compact image forming apparatus 2 and smaller space requirements.

Modules of the driven gear 28*d* and driving gear 44 are each set at more than 1.25. Thereby, in rough engagement between the driven gear 28*d* and the driving gear 44, the toner bottle 28 is turned. Therefore, the toner bottle 28 is prevented from vibrating greatly during its rotation, and toner does not adhere to the inner wall of the toner bottle 28. In other words, the toner is prevented from stagnating in the toner bottle 28. This enables the toner to be conveyed more smoothly. Accordingly, without depending on the quantity of toner in the toner bottle 28, the toner is supplied unchangeably. Additionally, since the source of vibrations generated by the rotation of the toner bottle 28 is situated at the bottom side of the toner bottle which is an upstream side in a conveyed direction of the toner, an ability to prevent the stagnation of the toner is improved.

As described above, according to the roughness in engagement between the gears, vibrations are provided to the toner bottle 28. This arrangement makes it possible to unify the rotation and vibration mechanisms of the toner bottle 28 into a single mechanism. Accordingly, a simple construction is realized. Even if the module of the gears is less than 1.25, the toner can be conveyed from the bottom side to the opening on the head side of the toner bottle 28. However, it is highly desirable to set the module thereof at more than 1.25 because vibrations generated by the engagement between the gears are small during the rotation of the toner bottle 28 and, as a result, the toner is liable to stagnate.

As shown in FIG. 4, the hopper 26 generally comprises a base 50, a front flange 52, a shaft member 54, a cylindrical case 56, a collet chuck 58, and a coiled spring 60.

The base 50 is formed integrally with the development casing 24. The front flange 52 is engaged with the base 50 on the side of the toner bottle 28. The cylindrical case 56 is formed integrally with the shaft member 54. The collet chuck 58 contained in the cylindrical case 56 is formed integrally with the shaft member 54. The coiled spring 60 always presses a series of constituent parts, i.e., the shaft member 54, the cylindrical case 56, the collet chuck 58, and the like toward the toner bottle 28.

The collet chuck 58 serves to hold and release the cap 28*c*. The cap 28*c* is opened and closed by operating the handle 42. In more detail, the handle 42 has a cam portion 62 as shown in FIG. 5. The shaft member 54 has a hole supporting a slide shaft 64 which is to come in contact with the cam portion 62. In conjunction with the rotation of the handle 42, the series of constituent parts, such as the collet chuck 58 and the like, can be slid in a direction away from the toner bottle 28.

As shown in FIG. 5, the base 50 of the hopper 26 has an opening through which toner discharged from the toner outlet 28*b* of the toner bottle 28 is introduced into a toner inlet of the development device 6. An elastic member 66 is stuck onto the opening with, for example, adhesive double coated tape. The elastic member 66 is made of an elastic material, such as PET (abbreviation of polyethylene terephthalate) or rubber. The elastic member 66 has a rectangular slit 66*a*. Depending on the width of the slit 66*a*, a replenishment of toner is regulated.

Figure 6:
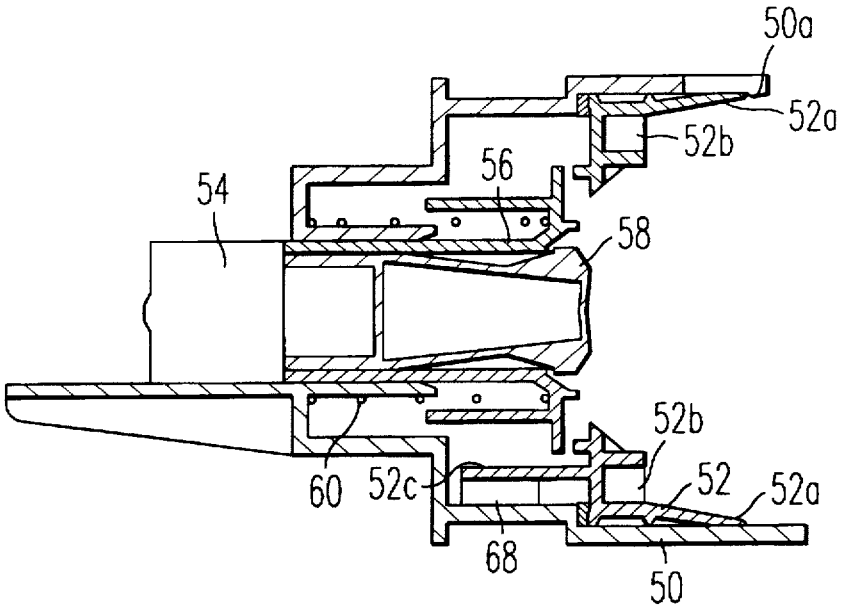
FIG. 6 is a side view of the development device in which a hopper portion is shown in section.

As shown in FIG. 6, the front flange 52 has an attachment guide portion 52*a* which gradually widens toward the inserted side of the toner bottle 28. The attachment guide portion 52*a* facilitates the attachment of the toner bottle 28. A rib 52*b* is mounted on the smaller-diameter side of the attachment guide portion 52*a*. As shown in FIG. 5, head projections 28*e* to be caught by the rib 52*b* are formed on the head of the toner bottle 28. Thereby, the toner bottle 28 can rotate together with the front flange 52. A rib 52*c* protrudes from the front flange 52 in a direction opposite to the toner bottle 28. The rib 52*c* is provided with paddles 68 for pushing the toner to the development unit. The paddle 68 is a toner pushing member made of an elastic material such as PET or rubber. The paddle 68 is stuck on the rib 52*c* with adhesive double coated tape. In this embodiment, three paddles 68 are mounted. Additionally, as shown in FIG. 5, a plurality of ribs 24*a* reinforce the inside of the attachment concave 40 of the development casing 24.

Second Embodiment

Figure 7:
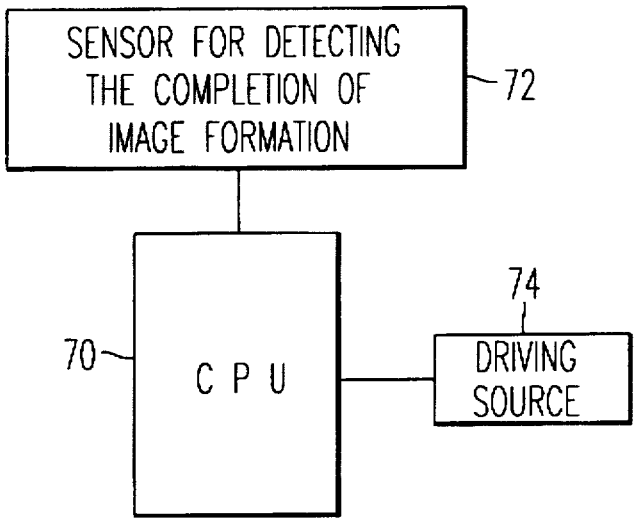
FIG. 7 is a block diagram of a control system in a second embodiment of the present invention.

FIG. 7 shows a construction in which the ability to prevent the stagnation of toner is enhanced even more by increasing vibrations generated when the toner bottle 28 is turned, although it demands a sacrifice of the structural simplification resulting from the use of a driving source mounted on the apparatus side. The construction in a second embodiment is substantially the same as that in the first embodiment, and differences therebetween are as follows.

The image forming apparatus 2 includes a micro computer used as a control means 70. The control means 70 takes a signal from, for example, a sensor 72 for detecting the completion of image formation and judges that the image formation is completed on the apparatus side. The image forming apparatus 2 also includes a driving source 74 exclusively used to drive and turn the toner bottle 28. The driving gear 44 is connected to the driving source 74.

When the control means 70 decides the completion of image formation, the control means 70 outputs an operational signal to the driving source 74 with a given timing and for a certain fixed time, so that the driving gear 44 rotates reversely. When the toner bottle 28 is thus reversed, the smooth engagement cannot be made between the driven gear 28*d* and the driving gear 44 because the properly engaged directions of the gears 28*d*, 44 are opposite to each other. Therefore, when the driving gear 44 is reversed, the toner bottle 28 rotates reversely while climbing up. As a result, the toner bottle 28 vibrates more greatly, and thereby the ability to prevent the toner stagnation is enhanced even more.

Third Embodiment

A description will now be given of a gear attachment construction of the toner bottle 28.

The toner bottle 28 in this embodiment is formed by blow-molding of polyethylene resin.

As shown in FIGS. 8(*a*) to 8(*c*), the diameter of the toner bottle 28 on the bottom side thereof is reduced. A driven gear 28*d* formed independently of the toner bottle 28 is attached to the diameter-reduced portion (attachment portion) 28*f* of the toner bottle 28. The driven gear 28*d* is inserted and fitted onto the attachment portion 28*f* from the bottom. In FIG. 8(*b*), arrow R indicates a rotational direction of the toner bottle 28.

A pair of projections 76 opposite to each other at an angle of 180° are formed on the outer surface of the attachment portion 28*f*. The projections 76 are used to turn the toner bottle 28. As shown in FIG. 8(*c*), the projection 76 shaped substantially trapezoidal has an engagement surface 76*a* and an inclined surface 76*b*. The engagement surface 76*a* is parallel to an inserted direction of the driven gear 28*d* indicated by arrow T whose direction is opposite to a removal direction of the driven gear 28*d*, and the inclined surface 76*b* inclines with respect to the inserted direction or removal direction of the driven gear 28*d*. The driven gear 28*d* has a pair of engagement concaves 78 a shape of each of which corresponds to that of the projection 76. The engagement concaves 78 are opposite to each other at an angle of 180°. The projection 76 serves to stop the rotation of the driven gear 28*d*.

An annular ridge 77 is formed integrally with the attachment portion 28*f* on the side closer to the bottom than the projections 76. The ridge 77 serves to prevent the driven gear 28*d* from slipping off from the attachment portion 28*f*.

Figure 9:
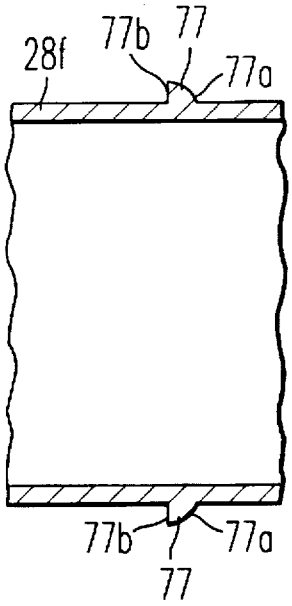
FIG. 9 is an enlarged sectional view of a slip-off preventive ridge formed on the toner bottle shown in FIGS. 8(*a*) and 8(*c*).

As shown in FIG. 9, the slip-off preventive ridge 77 is shaped substantially trapezoidal in section. The ridge 77 has an inclined surface 77*a* on the side closer to the bottom and an engagement surface 77*b* on the side away therefrom. The engagement surface 77*b* is perpendicular to the inserted direction of the driven gear 28*d*.

When the driven gear 28*d* is fitted onto the attachment portion 28*f*, the driven gear 28*d* goes beyond the slip-off preventive ridge 77 with the aid of the elastic deformation of the ridge 77. When the driven gear 28*d* has gone beyond the ridge 77, the ridge 77 elastically returns to its original state, and the driven gear 28*d* is prevented from slipping off by means of the engagement surface 77*b*. The height of the ridge 77 is set such that the driven gear 28*d* cannot easily slip off even if a pulling force (i.e., a force acting in a direction opposite to that of arrow T) is applied to the driven gear 28*d* after the driven gear 28*d* goes beyond the ridge 77 and is fitted on the attachment portion 28*f*.

Figure 10:
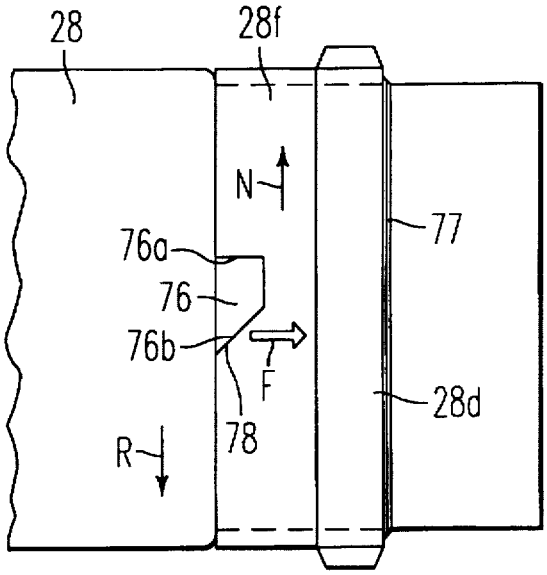
FIG. 10 is a partially enlarged side view for a description of how to remove the driven gear attached to an attachment part of the toner bottle in the third embodiment.
Figure 11A:
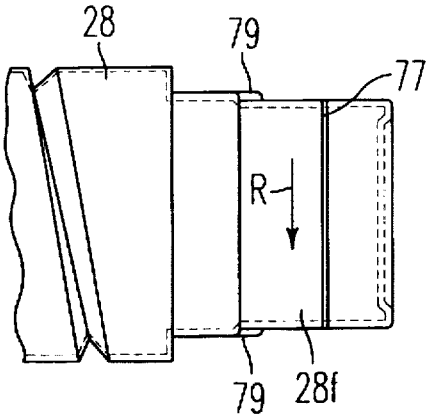
FIG. 11(*a*) is a partially side view of a main part of a toner bottle in a fourth embodiment of the present invention, FIG. 11(*b*) is a bottom view of the toner bottle a part of which is omitted, FIG. 11(*c*) is a partially side view of the main part of the toner bottle as a result of rotation of the toner bottle shown in FIG. 11(*a*) by an angle of 90°, and FIG. 11(*d*) is a side view of a driven gear which is to be mounted on the bottom portion of the toner bottle shown in FIGS. 11(*a*) to 11(*c*).
Figure 11B:
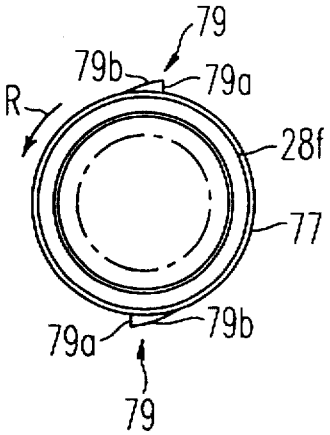
Figure 11C:
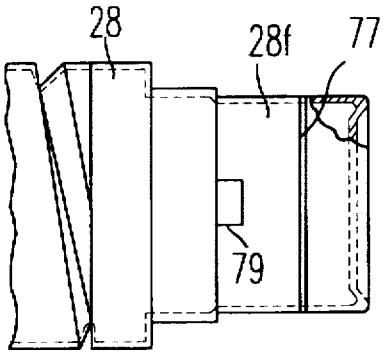
Figure 11D:
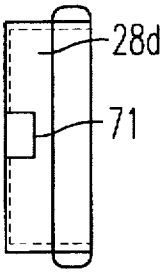

FIG. 10 depicts the driven gear 28*d* which has been attached to the attachment portion 28*f*. Owing to the engagement surface 76*a* of the projection 76, the driven gear 28*d* is completely prevented from rotating relatively with the toner bottle 28, and accordingly the driven gear 28*d* rotates together with the toner bottle 28 in a direction of arrow R.

On the other hand, when the driven gear 28*d* is turned in a direction of arrow N opposite to the direction of arrow R, the force applied to the driven gear 28*d* is divided, because of the inclined surface 76*b*, into a force component by which the rotation of the driven gear 28*d* is stopped and a force component F in a direction in which the driven gear 28*d* slips off. By the force component F, the driven gear 28*d* can go beyond the ridge 77 and be removed from the attachment portion 28*f*.

If a construction is adopted in which the driven gear 28*d* is pulled in the removal direction opposite to that of arrow T, the operator frequently feels a pain in the hand because the operator must pull the driven gear 28*d* while grasping the teeth of the driven gear 28*d* in the hand and, especially when the driven gear 28*d* goes beyond the ridge 77, the operator must pull it with even greater force.

However, as in this embodiment, if a construction is adopted in which the driven gear 28 is turned in the direction opposite to that of arrow R so as to remove the driven gear 28, the driven gear 28 can be easily removed from the toner bottle 28 without pain because a great pulling force is obtained by applying a rotational force to the driven gear 28 and accordingly the teeth thereof are prevented from cutting into the hand even if the teeth are grasped.

According to this construction in the third embodiment, since the driven gear 28*d* is disjoinable from the toner bottle, this is preferable from the viewpoint of recycling the toner bottle 28. Additionally, it is possible to easily carry out an operation for removing the driven gear 28*d* from the toner bottle 28.

Fourth Embodiment

As shown in FIGS. 11(*a*) and 11(*b*), a pair of projections 79 opposite to each other at an angle of 180° are formed integrally with the attachment portion 28*f*. The projection 79 has an engagement surface 79*a* radially extending and a smooth taper surface 79*b* gradually thinning in the rotational direction of the toner bottle 28. In other words, the tapered surface 79*b* draws an arc gradually lowering in the rotational direction of the toner bottle 28.

Correspondingly, the driven gear 28*d* has a pair of engagement concaves 71 which are closely engaged with the pair of projections 79, respectively. When the driven gear 28*d* is turned in the direction of arrow R, the toner bottle is turned together with the driven gear 28*d*, as in the third embodiment.

Figure 12:
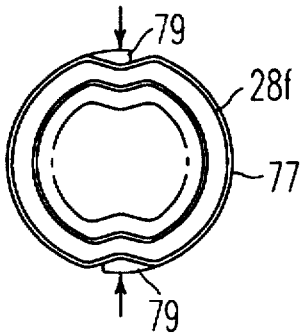
FIG. 12 shows a variant of the bottom portion of the toner bottle shown in FIGS. 11(*a*) to 11(*c*).

On the other hand, in this embodiment, when the driven gear 28*d* is turned in a direction opposite to the rotational direction (i.e., in a direction opposite to that of arrow R) of the toner bottle, the inner surface of the driven gear 28*d* slides on the tapered surface 79*b* of the projection 79. When the driven gear 28*d* is turned in the opposite direction even more, the attachment portion 28*f* of the toner bottle 28 is deformed as shown in FIG. 12 because of pressure generated by the rotation of the driven gear 28*d*. Accordingly, the annular slip-off preventive ridge 77 is deformed and dented, and thereby the driven gear can be easily removed from the toner bottle 28.

Modification

Figure 13A:
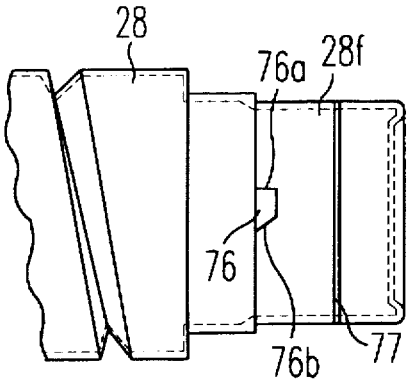
FIG. 13(*a*) is a side view of a main part of a variant of the toner bottle shown in the third embodiment, and FIG. 13(*b*) is a bottom view of the variant toner bottle a part of which is omitted.
Figure 13B:
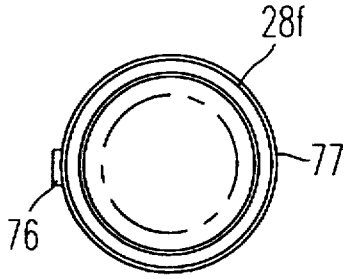
Figure 14:
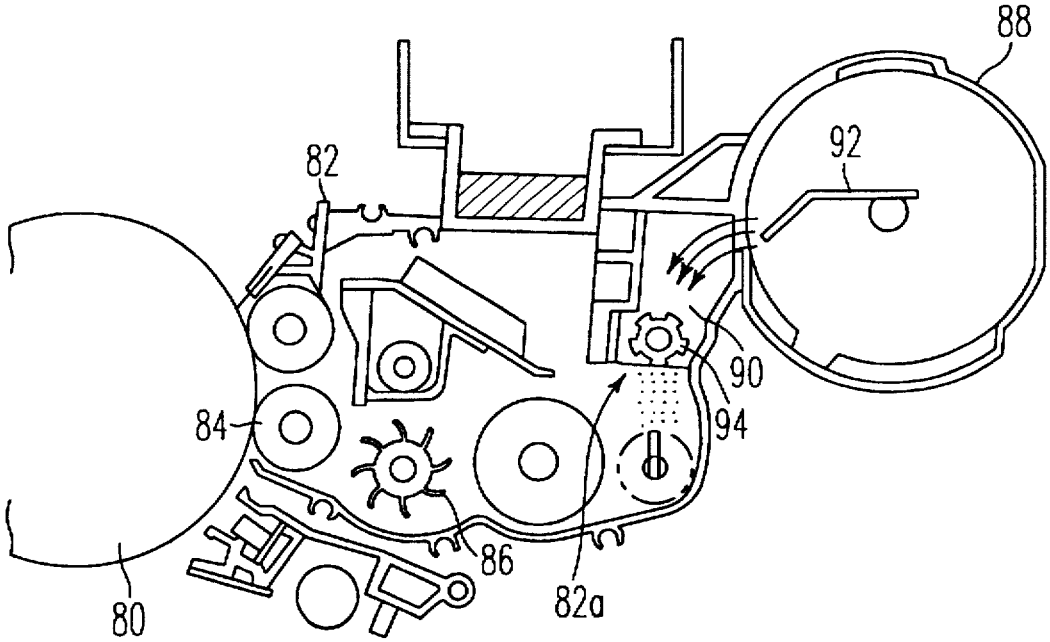
FIG. 14 PRIOR ART
FIG. 14 is a sectional view schematically showing a conventional development device of an image forming apparatus.

As shown in FIGS. 13(*a*) and 13(*b*), the projection 76 shown in FIG. 8 is formed at only one place, and a corresponding engagement concave 78 of the driven gear 28*d* is formed at only one place. If the number of projections 76 is thus made one, a chance to go beyond the slip-off preventive ridge 77 can be easily taken because a removing force concentrates at one point of the ridge 77 in comparison with the case of two projections 76. Likewise, the number of projections 79 may be made one.

What is claimed is:

1. A development device of an image forming apparatus wherein an opening portion formed in a head of a toner bottle containing a toner is attached to a body of said development device and said toner bottle is then turned so as to supply said development device with the toner;

wherein said toner bottle has a circumferentially extending projection formed thereon adjacent a bottom side of said toner bottle, for turning said toner bottle, and said development device includes a driving source for turning said toner bottle through said projection when said toner bottle is attached to the body of said development device.

2. The development device of claim 1, further comprising a driven gear which is formed independently of said toner bottle and is rotatable in conjunction with rotation of said driving source, said driven gear being attached to a bottom portion of said toner bottle and engaged with a projection.

3. The development device of claim 2, wherein said driven gear is freely attachable to said toner bottle and detachable therefrom.

4. The development device of claim 2, further comprising a driving gear mounted on the side of said development device, said driving gear being turned by said driving source and engaged with said driven gear.

5. The development device of claim 4, wherein a module of said driven gear and a module of said driving gear are each more than 1.25.

6. The development device of one of claims 1 to 5, wherein said driving source is used merely for turning said toner bottle and is reversed with a given timing.

7. The development device of one of claims 1 to 5, wherein said driving source for turning said toner bottle is used as a driving source for turning not only said toner bottle but also a development sleeve.

8. A development device of an image forming apparatus wherein an opening portion formed in a head of a toner bottle containing a toner is attached to a hopper mounted on a body side of said development device and said toner bottle is then turned so as to supply said development device with the toner;

wherein said toner bottle has a driven gear which is formed integrally with said toner bottle on a circumferential surface on a bottom side of said toner bottle, and said development device includes a driving gear which is engaged with said driven gear when said toner bottle is attached to the body of said development device.

9. The development device of claim 8, wherein said driving gear is connected, through a junction gear, to a driving source, mounted on the body side of said development device, for driving a development sleeve.

10. The development device of claim 8 or 9, wherein a module of said driven gear and a module of said driving gear are each more than 1.25.

11. The development device of claim 10, further comprising an exclusive driving source for driving and turning said toner bottle independently of said driving source for driving the development sleeve, said exclusive driving source reversing said driving gear with a given timing.

12. A toner bottle wherein an opening portion formed in a head of said toner bottle is attached to a development device and said development device is supplied with toner by rotation of said toner bottle, said toner bottle having a circumferentially extending projection formed thereon adjacent a bottom side of said toner bottle, for turning said toner bottle by means of a driving source mounted on a side of said development device.

13. The toner bottle of claim 12 further having a driven gear detachably attached to the bottom side of said toner bottle, said driven gear being to be engaged with a driving gear disposed on the side of said development device, said driven gear being engaged with an engagement projection serving to prevent said driven gear from rotating.

14. The toner bottle of claim 13, wherein said engagement projection has an engagement surface parallel to a removal direction of said driven gear and an inclined surface inclining with respect to the removal direction.

15. The toner bottle of claim 13, wherein said engagement projection has an engagement surface extending radially and a tapered surface becoming gradually smaller in height in a rotational direction.

16. The toner bottle of one of claims 13 to 15, wherein said engagement projection is one in number.

17. A toner bottle wherein an opening portion formed in a head of said toner bottle is attached to a development device and said development device is supplied with toner by the rotation of said toner bottle, said toner bottle having a projection formed on a bottom side of said toner bottle, for turning said toner bottle by means of a driving source mounted on a side of said development device, said toner bottle further having a driven gear detachably attached to the bottom side of said toner bottle, said driven gear being engagable with a driving gear disposed on a side of said development device, said driven gear being engaged with an engagement projection serving to prevent said driven gear from rotating.

* * * * *